US012447516B2

(12) United States Patent
Huo et al.

(10) Patent No.: US 12,447,516 B2
(45) Date of Patent: Oct. 21, 2025

(54) SINGLE-TOOTH TRACK PLATE COGGING-DOWN PASS AND HOT ROLLING METHOD

(71) Applicant: SHANDONG IRON AND STEEL COMPANY LTD., Shandong (CN)

(72) Inventors: Xiwei Huo, Shandong (CN); Xiaoqing Sun, Shandong (CN); Guoming Shang, Shandong (CN); Jinli Ji, Shandong (CN); Cheng Li, Shandong (CN); Gang Lei, Shandong (CN)

(73) Assignee: SHANDONG IRON AND STEEL COMPANY LTD., Shandong (CN)

( * ) Notice: Subject to any disclaimer, the term of this patent is extended or adjusted under 35 U.S.C. 154(b) by 0 days.

(21) Appl. No.: 18/841,522

(22) PCT Filed: Aug. 1, 2022

(86) PCT No.: PCT/CN2022/109504
§ 371 (c)(1),
(2) Date: Aug. 26, 2024

(87) PCT Pub. No.: WO2023/098123
PCT Pub. Date: Jun. 8, 2023

(65) Prior Publication Data

US 2025/0108419 A1 Apr. 3, 2025

(30) Foreign Application Priority Data

Jul. 26, 2022 (CN) ..... 202210887603.2

(51) Int. Cl.
*B21B 1/38* (2006.01)

(52) U.S. Cl.
CPC ..... *B21B 1/38* (2013.01)

(58) Field of Classification Search
CPC ..... B21B 1/085; B21B 1/092
(Continued)

(56) References Cited

U.S. PATENT DOCUMENTS 294,757 A * 3/1884 Brown ..... B21B 1/0855 72/204
4,420,962 A * 12/1983 Peterson ..... B21J 13/02 72/356

FOREIGN PATENT DOCUMENTS

CN 102321841 A * 1/2012
CN 202343561 U 7/2012
(Continued)

OTHER PUBLICATIONS

International Search Report of the corresponding International Application No. PCT/CN2022/109504, dated Dec. 21, 2022.

*Primary Examiner* — Christopher L Templeton
*Assistant Examiner* — P Derek Pressley
(74) *Attorney, Agent, or Firm* — Global IP Counselors, LLP

(57) ABSTRACT

Analysis shows that the present disclosure discloses a single-tooth track plate cogging-down pass and a hot rolling method, comprising a first cogging hole and a second cogging hole, the first cogging hole is formed by a first upper roller and a first lower roller of a cogging mill, and the second cogging hole is formed by a second upper roller and a second lower roller of the cogging mill, wherein the first cogging hole is a front hole, and the first cogging hole is used to extrude the rectangular continuous casting billet into a mountain shaped middle billet including a right bent limb, a first center column, and a left bent limb, wherein the second cogging hole is a rear hole, the second cogging hole is used to extrude the mountain shaped middle billet into an inverted T-shaped middle billet including a right flat limb, a second center column, and a left flat limb. The present disclosure significantly reduces the dependence on billet size, allowing for the production of larger single-tooth track plates using smaller billets, which has a good energy-saving and consumption reducing effect. The unique design of the
(Continued)

first and second cogging holes eliminate the shortcomings of low efficiency, poor safety, and poor dimensional accuracy caused by the instability of billets, and realizes the efficient production of single-tooth track plate.

7 Claims, 3 Drawing Sheets

(58) Field of Classification Search
USPC ..... 72/199, 200
See application file for complete search history.

(56) References Cited

FOREIGN PATENT DOCUMENTS

| | | | | | |
|---|---|---|---|---|---|
| CN | 103350114 | A | | 10/2013 | |
| CN | 103447443 | A | | 12/2013 | |
| CN | 105458002 | A | * | 4/2016 | |
| CN | 212639190 | U | | 3/2021 | |
| CN | 113560341 | A | | 10/2021 | |
| CN | 215785675 | U | | 2/2022 | |
| JP | 59189008 | A | * | 10/1984 | ..... B21B 1/092 |
| SU | 1676689 | A1 | * | 9/1991 | |

* cited by examiner

SINGLE-TOOTH TRACK PLATE COGGING-DOWN PASS AND HOT ROLLING METHOD

FIELD OF INVENTION

The present disclosure relates to the field of section steel production technology, in particular to a single-tooth track plate cogging-down pass and a hot rolling method.

BACKGROUND OF THE INVENTION

Tracks are commonly used walking components in construction machinery. Compared to tires, tracks can be applied in various harsh working environments and have advantages such as wear resistance and impact resistance. Track plates are essential metallurgical products for the production of tracks, with various forming methods such as casting, stamping, mechanical processing, and rolling. Compared with casting, stamping, and machining methods, the rolling forming method has high efficiency, low cost, and excellent comprehensive performance, making it increasingly widely used. On the other hand, due to the complex and asymmetric cross-sectional shape of the track plate, it is difficult to control the deformation of the rolled piece during the rolling process, which is prone to bending, twisting, pouring and stacking, making it difficult to achieve automated production. Therefore, the formation of track plates, especially the single-tooth track plates with high degree of asymmetry, has to be produced by manually assisted rolling and biting, greatly increasing the risk of personal injury accidents.

Chinese patent CN201310393973.1 discloses a single-tooth track plate semi-open and semi-closed blanking mold and a single-tooth track plate forging method. Its purpose is to provide a semi-open and semi-closed blanking mold for single-tooth track plates that can be used for pre forging billets of single-tooth track plates and the resulting forgings are easier to perform final forging, and to provide a single-tooth track plate forging method using forging technology and for forging the single-tooth track plate. This forging method produces track plates with low yield and high cost.

In the paper "Finite Element Simulation of Track Steel Rolling Process" published in the third issue of "Steel Vanadium Titanium" on Jul. 30, 2009, a rolling process for track steel was involved, it was pointed out that a single-tooth track steel has a complex cross-sectional shape and is prone to twisting, warping, and lateral bending during the rolling process, which affects the smooth rolling process. In response to the problem of severe torsion in deep hole cutting of track steel, the pass parameters were optimized to reduce the torsion angle during the rolling process of deep hole cutting of track steel from 135.6° to 13.85°, meeting the requirements for normal bite in subsequent passes and ensuring the smooth progress of production. The rolling process mentioned in this document not only has serious torsion problems with the 6 holes mentioned in the text, but also includes 3 box shaped holes, including 1 hole, 2 holes, and 3 holes, for material shrinkage, increasing the length and pass of the rolling roller, resulting in low production efficiency and high energy consumption. In addition, 4 holes, 5 holes, and 8 holes all have prominent problems such as unstable support state at the bottom of the rolled piece, easy tilting or overturning after steel turning, and affecting subsequent rolling. Not only is the dimensional accuracy difficult to control, but it also requires manual assistance in biting the rolled piece, which is not conducive to improving production rhythm and controlling safety risks.

SUMMARY

The purpose of the present disclosure is to provide a single-tooth track plate cogging-down pass and a hot rolling method, which can achieve a good middle billet shape while ensuring stable support at the bottom of billet, without tilting or overturning after steel turning, and can achieve efficient hot rolling production of the single-tooth track plates without the need for manual assistance.

In order to achieve the above-mentioned purposes, the present disclosure provides the following technical embodiments:

A single-tooth track plate cogging-down pass comprises a first cogging hole and a second cogging hole, wherein the first cogging hole is formed by a first upper roller and a first lower roller of a cogging mill, and the second cogging hole is formed by a second upper roller and a second lower roller of the cogging mill, wherein the first cogging hole is a front hole, and the first cogging hole is used to extrude a rectangular continuous casting billet into a mountain shaped middle billet including a right bent limb, a first center column, and a left bent limb, wherein the second cogging hole is a rear hole, the second cogging hole is used to extrude the mountain shaped middle billet into an inverted T-shaped middle billet including a right flat limb, a second center column, and a left flat limb.

Furthermore, in above-mentioned single-tooth track plate cogging-down pass, a lower surface of the first upper roller includes a first inclined plane, a first plane, a second inclined plane, a second plane, a third inclined plane, a third plane, and a fourth inclined plane, the first inclined plane, the first plane, the second inclined plane, the second plane, the third inclined plane, the third plane, and the fourth inclined plane are sequentially connected, the first plane and the third plane are located on a same horizontal plane, the first inclined plane, the second inclined plane, the third inclined plane, and the fourth inclined plane are all located above the first plane, the second plane is parallel to the first plane, the second inclined plane, the second plane, and the third inclined plane form a trapezoidal groove on the lower surface of the first upper roller.

Furthermore, in above-mentioned single-tooth track plate cogging-down pass, an angle $\alpha$ between the first inclined plane and the first plane is 30°-70°, an angle $\beta$ between the second inclined plane and the first plane is 65°-88°, an angle $\gamma$ between the third inclined plane and the third plane is 65°-88°, an angle $\delta$ between the fourth inclined plane and the third plane is 30°-70°, specifically, a smooth transition is achieved between the second inclined plane and the second plane, between the second plane and the third inclined plane through an arc with a radius of 10 mm to 30 mm, a smooth transition is achieved between the first inclined plane and the first plane, between the first plane and the second inclined plane, between the third inclined plane and the third plane, and between the third plane and the fourth inclined plane through an arc with a radius of 25 mm to 60 mm, specifically, a length of the first inclined plane is B1, and a vertical distance between the second plane and the first plane is H1, and B1:H1=0.7~2:1, a length of the fourth inclined plane is B2, and B2:H1=0.5~1.2:1.

Furthermore, in above-mentioned single-tooth track plate cogging-down pass, an upper surface of the first lower roller includes a fifth inclined plane, a fourth plane, and a sixth inclined plane, the fifth inclined plane, the fourth plane, and the sixth inclined plane are sequentially connected, and the fifth inclined plane and the sixth inclined plane are both located above the fourth plane, specifically, an angle ε between the fifth inclined plane and the fourth plane is 50°-88°, an angle ζ between the fourth plane and the sixth inclined plane is 50°-88°, specifically, a smooth transition is achieved between the fifth inclined plane and the fourth plane, and between the fourth plane and the sixth inclined plane through an arc with a radius of 25 mm to 60 mm.

Furthermore, in above-mentioned single-tooth track plate cogging-down pass, a lower surface of the second upper roller includes a seventh inclined plane, an eighth inclined plane, a ninth inclined plane, a fifth plane, a tenth inclined plane, an eleventh inclined plane, and a twelfth inclined plane, the seventh inclined plane, the eighth inclined plane, the ninth inclined plane, the fifth plane, the tenth inclined plane, the eleventh inclined plane, and the twelfth inclined plane are sequentially connected, the fifth plane is set horizontally, and lower ends of the seventh inclined plane and the twelfth inclined plane are located on a same horizontal plane, the eighth inclined plane and the eleventh inclined plane are both located above the twelfth inclined plane, the ninth inclined plane and the tenth inclined plane are both located above the eleventh inclined plane, the ninth inclined plane, the fifth plane, and the tenth inclined plane form a trapezoidal groove on a lower surface of the second upper roller.

Furthermore, in above-mentioned single-tooth track plate cogging-down pass, an angle η between the seventh inclined plane and the horizontal plane is 60°-88°, an angle θ between the eighth inclined plane and the horizontal plane is 0°-30°, an angle between the ninth inclined plane and the fifth plane is 70°-88°, an angle κ between the tenth inclined plane and the fifth plane is 70°-88°, an angle λ between the eleventh inclined plane and the horizontal plane is 0°-30°, an angle μ between the twelfth inclined plane and the horizontal plane is 60°-88°, specifically, an smooth transition is achieved between the seventh inclined plane and the eighth inclined plane, between the ninth inclined plane and the fifth plane, between the fifth plane and the tenth inclined plane, and between the eleventh inclined plane and the twelfth inclined plane through an arc with a radius of 10 mm to 30 mm, a smooth transition is achieved between the eighth inclined plane and the ninth inclined plane, and between the tenth inclined plane and the eleventh inclined plane through an arc with a radius of 50 mm to 80 mm.

Furthermore, in above-mentioned single-tooth track plate cogging-down pass, an upper surface of the second lower roller includes a sixth plane, an arc segment, and a seventh plane, the sixth plane, the arc segment, and the seventh plane are sequentially connected, and the sixth plane and the seventh plane are located on a same horizontal plane, the arc segment is located above the sixth plane, a radius of the arc segment is 50 mm to 120 mm and a length of the arc segment is 80 mm to 200 mm.

Furthermore, in above-mentioned single-tooth track plate cogging-down pass, a length of the right flat limb is B3, and a vertical distance between the fifth plane and the sixth plane is H2, and B3:H2=1-2:1, a length of the left flat lamb is B4, and B4:H2=0.6-1.2:1.

Furthermore, in above-mentioned single-tooth track plate cogging-down pass, a width of the continuous casting billet is not less than a width W1 of the fourth plane on an upper surface of the first lower roller, a width of the continuous casting billet is not greater than a width W2 of the first cogging hole, and a ratio of the height to the width of the continuous casting billet is 0.7-1.3.

On the other hand, a hot rolling method for single-tooth track plate is provided, utilizing the above-mentioned single-tooth track plate cogging-down pass, which includes the following steps:

step 1) using the cogging mill to cog down the rectangular continuous casting billet, the continuous casting billet are rolled sequentially by 1 to 4 first cogging holes, and the continuous casting billet is gradually rolled out into the right bent limb, the first center column, and the left bent limb, the first inclined plane and the first plane cooperate with the fifth inclined plane and the fourth plane to form the right bent limb, the second inclined plane, the second plane and the third inclined plane cooperate with the fourth plane to form the first center column, the third plane and the fourth inclined plane cooperate with the fourth plane and the sixth inclined plane to form the left bent limb, and a cross-section of the continuous casting billet changes from a rectangle to a mountain shape, thus obtaining a mountain shaped middle billet.

step 2), using the cogging mill to further cog down the mountain shaped middle billet obtained in step 1), and the mountain shaped middle billet is rolled by 1 to 4 second cogging holes, the seventh inclined plane and the eighth inclined plane cooperate with the sixth plane to gradually flatten and thin the right bent limb of the mountain shaped middle billet to form the right flat limb, the ninth inclined plane, the fifth plane, and the tenth inclined plane cooperate with the arc segment to gradually thin and grow the first center column to form the second center column, and to extrude the fourth plane out into the arc segment, the eleventh inclined plane and the twelfth inclined plane cooperate with the seventh plane to gradually flatten and thin the left bent limb to form the left flat limb, a cross-section of the mountain shaped middle billet changes from a mountain shape to an inverted T-shape, thus obtaining an inverted T-shaped middle billet.

step 3) roughly rolling the inverted T-shaped middle billet obtained by cogging down the first cogging hole and the second cogging hole to reduce the thickness and increase the width of the billet.

step 4) performing finish rolling on the rough rolled billet in Step 3, and accurately shape each part of the billet corresponding to a main plate, a side wing, and a tooth plate of the single-tooth track plate to obtain the single-tooth track plate, wherein the right flat limb is rolled into the main plate of the single-tooth track plate, the second center column is rolled into the side wing of the single-tooth track plate, and the left flat limb is rolled into the tooth plate of the single-tooth track plate.

Analysis shows that the present disclosure discloses a single-tooth track plate cogging-down pass and a hot rolling method. The rectangular continuous casting billet is cogged down through the first and second cogging holes of the cogging mill, and the billet after cogging down is then rough and finish rolled to obtain the single-tooth track plate. The present disclosure significantly reduces the dependence on billet size, allowing for the production of larger single-tooth track plates using smaller billets, which has a good energy-saving and consumption reducing effect. The unique design of the first and second cogging holes eliminate the shortcomings of low efficiency, poor safety, and poor dimensional accuracy caused by the instability of billets, and realizes the efficient production of single-tooth track plate.

BRIEF DESCRIPTION OF THE DRAWINGS

The attached drawings forming a part of this application are used to provide a further understanding of the present disclosure. The schematic embodiments and explanations of the present disclosure are used to explain the present disclosure and do not constitute an improper limitation of the present disclosure.

EXPLANATION OF ATTACHED DRAWING REFERENCES

Figure 1:
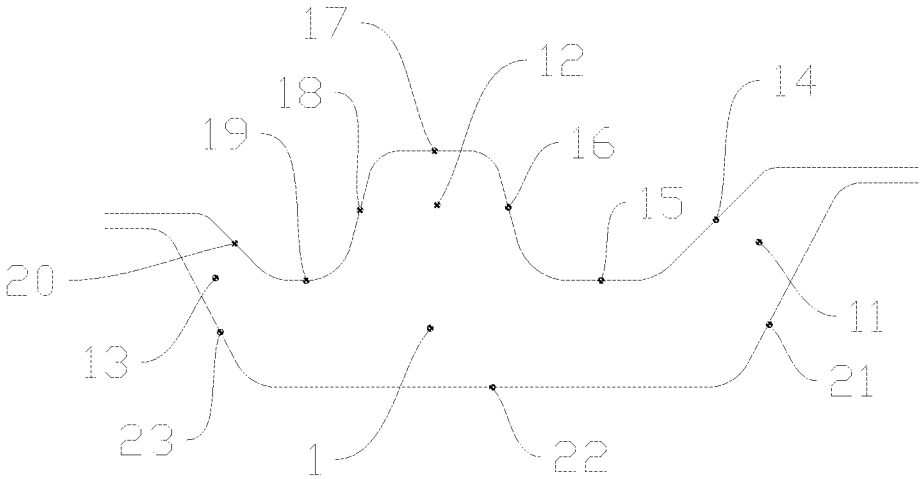
FIG. 1 shows a structural schematic diagram of a first cogging hole in an embodiment of the present disclosure.

1 first cogging hole; 11 right bent limb; 12 first center column; 13 left bent limb; 14 first inclined plane; 15 first plane; 16 second inclined plane; 17 second plane; 18 third inclined plane; 19 third plane; 20 fourth inclined plane; 21 fifth inclined plane; 22 fourth plane; 23 sixth inclined plane; 3 second cogging hole; 31 right flat limb; 32 second center column; 33 left flat limb; 34 seventh inclined plane; 35 eighth inclined plane; 36 ninth inclined plane; 37 fifth plane; 38 tenth inclined plane; 39 eleventh inclined plane; 40 twelfth inclined plane; 41 sixth plane; 42 arc segment; 43 seventh plane; 5 single-tooth track plate; 51 main plate; 52 tooth plate; 53 side wing.

DETAILED DESCRIPTION OF THE EMBODIMENTS

In the following text, the present disclosure will be explained in detail with reference to the attached drawings and embodiments. Each embodiment is provided through the explanation of the present disclosure rather than limiting it. In fact, those skilled in the art will be aware that modifications and variations can be made in the present disclosure without departing from the scope or spirit of the present disclosure. For example, features shown or described as a part of one embodiment may be used in another embodiment to generate another embodiment. Therefore, it is expected that the present disclosure includes such modifications and variations within the scope of the attached claims and their equivalents.

In the description of the present disclosure, it should be understood that the orientation or positional relationship indicated by the terms "vertical direction", "horizontal direction", "up", "down", "front", "back", "left", "right", "vertical", "horizontal", "top", "bottom" and the like is based on the orientation or positional relationships shown in the attached drawings, which is only for the convenience of describing the present application and simplifying the description, rather than indicating or implying that the indicated apparatus or component must have a specific orientation, be constructed and operated in a specific orientation, and therefore cannot be understood as a limitation on the present disclosure. In the present disclosure, unless otherwise specified and limited, the terms "connected", "connection", "installation" and other terms should be broadly understood, for example, they can be fixed connections, detachable connections, or integrated. It can be a mechanical connection or an electrical connection. It can be directly connected or indirectly connected through an intermediate medium, which can be the internal connection between two components or the interaction relationship between two components. For those skilled in the art, the specific meanings of the above-mentioned terms in the present disclosure can be understood based on specific circumstances.

One or more embodiments of the present disclosure are shown in the attached drawings. The detailed description uses numerical and letter markings to refer to the features in the attached drawings. Same or similar markings in the drawings and descriptions have been used to refer to same or similar parts of the present disclosure. As used in this present disclosure, the terms "first", "second", and "third" are interchangeable to distinguish one component from another and are not intended to indicate the position or importance of individual components.

Figure 2:
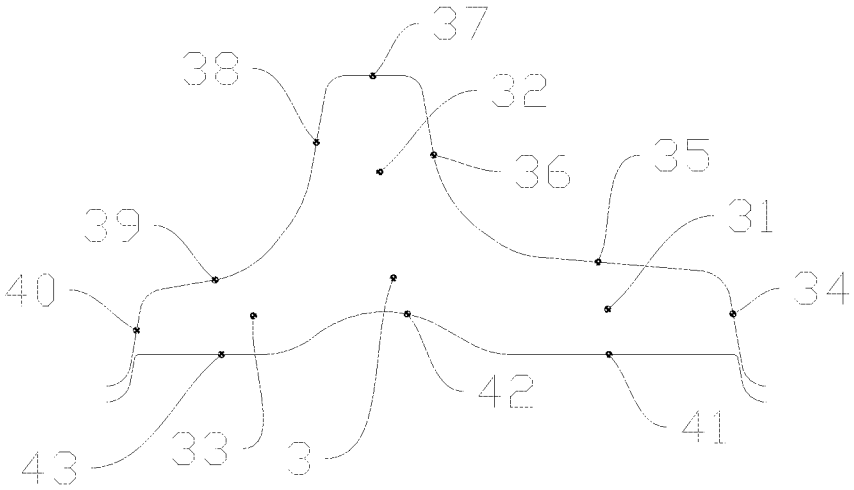
FIG. 2 shows a structural schematic diagram of a second cogging hole in an embodiment of the present disclosure.
Figure 3:
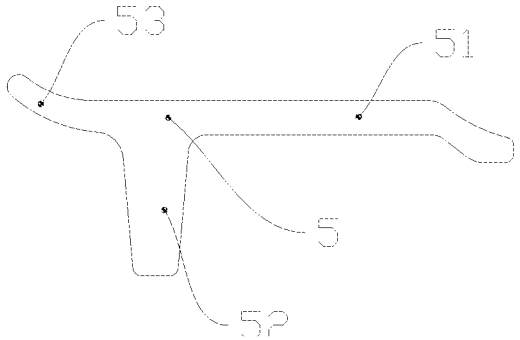
FIG. 3 shows a structural schematic diagram of a single-tooth track plate in an embodiment of the present disclosure.

As shown in FIGS. 1 to 5, according to an embodiment of the present disclosure, a single-tooth track plate cogging-down pass is provided, as shown in FIG. 3, the single-tooth track plate 5 includes a main plate 51, a tooth plate 52, and a side wing 53. One end of the side wing 53 is connected to one end of the main plate 51, another end of the side wing 53 extends away from the main plate 51, and one end of the tooth plate 52 is connected to a lower surface of the main plate 51.

The cogging-down pass comprises a first cogging hole 1 and a second cogging hole 3, the first cogging hole 1 is formed by a first upper roller and a first lower roller of a cogging mill, and the second cogging hole 3 is formed by a second upper roller and a second lower roller of the cogging mill, wherein the first cogging hole 1 is a front hole, and the first cogging hole 1 is used to extrude the rectangular continuous casting billet into a mountain shaped middle billet including a right bent limb 11, a first center column 12, and a left bent limb 13, wherein the second cogging hole 3 is a rear hole, the second cogging hole 3 is used to extrude the mountain shaped middle billet into an inverted T-shaped middle billet including a right flat limb 32, a second center column 32, and a left flat limb 33. In the process of rolling the single-tooth track plate 5 with the first cogging hole 1 and the second cogging hole 3 of the cogging mill, the shortcomings of low efficiency, poor safety and poor dimensional accuracy caused by the instability of billet can be eliminated, and the efficient production of the single-tooth track plate 5 can be realized.

Furthermore, as shown in FIG. 1, a lower surface of the first upper roller includes a first inclined plane 14, a first plane 15, a second inclined plane 16, a second plane 17, a third inclined plane 18, a third plane 19, and a fourth inclined plane 20, the first inclined plane 14, the first plane 15, the second inclined plane 16, the second plane 17, the third inclined plane 18, the third plane 19, and the fourth inclined plane 20 are sequentially connected, the first plane 15 and the third plane 19 are located on the same horizontal plane, the first inclined plane 14, the second inclined plane 16, the third inclined plane 18, and the fourth inclined plane 20 are all located above the first plane 15, the second plane 17 is parallel to the first plane 15, the second inclined plane 16, the second plane 17, and the third inclined plane 18 form a trapezoidal groove on the lower surface of the first upper roller. The upper surface of the first lower roller includes a fifth inclined plane 21, a fourth plane 22, and a sixth inclined plane 23. The fifth inclined plane 21, the fourth plane 22, and the sixth inclined plane 23 are sequentially connected, and the fifth inclined plane 21 and the sixth inclined plane 23 are all located above the fourth plane 22.

The first inclined plane 14 and the first plane 15 cooperate with the fifth inclined plane 21 and the fourth plane 22 to form the right bent limb 11 of the first cogging hole 1. The second inclined plane 16, the second plane 17, and the third inclined plane 18 cooperate with the fourth plane 22 to form the first center column 12 of the first cogging hole 1, the third plane 19 and the fourth inclined plane 20 cooperate with the fourth plane 22 and the sixth inclined plane 23 to form the left binding limb 13 of the first cogging hole 1. The right bent limb 11 and the left bent limb 13 are both curved structures. The bending design of the right bent limb 11 and the left bent limb 13 can maximize the width and height of each part of the billet corresponding to the main plate 51, the tool plate 52, and the side wing 53 of the single-tooth track plate 5. Thus, the single-tooth track plate 5 can be rolled using smaller billets, with fewer rolling passes, high production process efficiency, low energy consumption, and in line with the national green and low-carbon industry policy. The combination of the fifth inclined plane 21, the fourth plane 22, and the sixth inclined plane 23 forms a groove structure at the bottom of the first cogging hole 1, enabling the first upper roller and the first lower roller of the cogging mill to stably clamp the billet, ensuring stable support state at the bottom of the billet, and achieving stable rolling. Furthermore, it can achieve control over the dimensional accuracy of the billet, effectively reducing the degree of torsion and bending of the billet during the rolling process, and preventing subsequent rolling from being affected by the inclination or overturning of the billet. It does not require manual assistance in biting the rolled piece, effectively improving the production rhythm and reducing safety risks.

Figure 4:
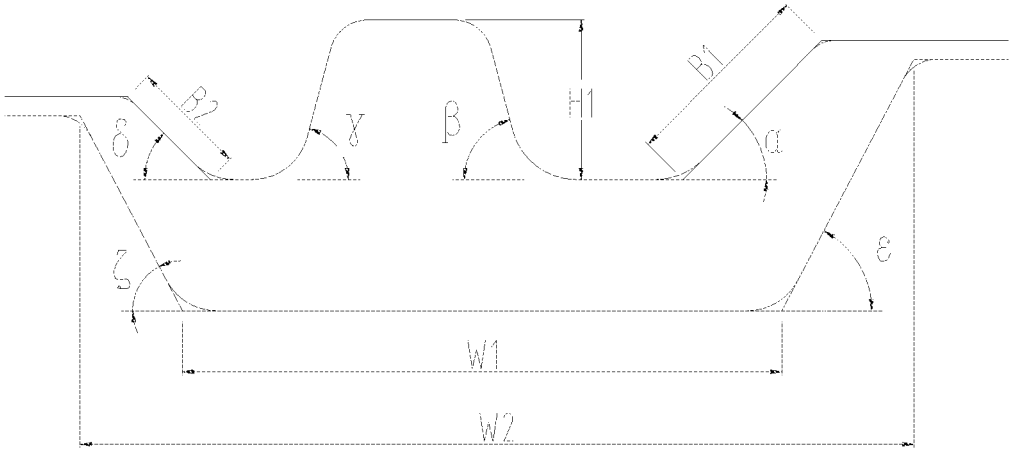
FIG. 4 shows another structural schematic diagram of a first cogging hole in an embodiment of the present disclosure.

Furthermore, as shown in FIG. 4, an angle α between the first inclined plane 14 and the first plane 15 is 30°-70° (e.g. 30°, 35°, 40°, 45°, 50°, 55°, 60°, 65°, 70°), the tilt angle design of the first inclined plane 14 can ensure that the billet is stable during the rolling of the first cogging hole 1, while providing a suitable length of billet for the right flat lamb 31 of the second cogging hole 3, to prevent the occurrence of insufficient or excessive metal. An angle β between the second inclined plane 16 and the first plane 15 is 65°-88° (e.g. 65°, 67°, 70°, 72°, 74°, 76°, 78°, 80°, 82°, 84°, 86°, 88°). An angle γ between the third inclined plane 18 and the third plane 19 is 65°-88° (e.g. 65°, 67°, 70°, 72°, 74°, 76°, 78°, 80°, 82°, 84°, 86°, 88°). An angle δ between the fourth inclined plane 20 and the third plane 19 is 30°-70° (e.g. 30°, 35°, 40°, 45°, 50°, 55°, 60°, 65°, 70°). The tilt angle design of the fourth inclined plane 20 can ensure the stable rolling of the first cogging hole 1 on the billet, while providing a suitable length of billet for the left flat lift 33 of the second cogging hole 3, to prevent the occurrence of insufficient or excessive metal. An angle ε between the fifth inclined plane 21 and the fourth plane 22 is 50°-88° (e.g. 50°, 55°, 60°, 65°, 70°, 75°, 80°, 85°, 88°). An angle ζ between the fourth plane 22 and the sixth inclined plane 23 is 50°-88° (e.g. 50°, 55°, 60°, 65°, 70°, 75°, 80°, 85°, 88°). In an embodiment of the present disclosure, α is 45°, β is 75°, γ is 75°, δ is 45°, ε is 62°, ζ is 62°.

Appropriate arc transitions are achieved between the second inclined plane 16 and the second plane 17, as well as between the second plane 17 and the third inclined plane 18. Specifically, the smooth transitions are achieved between the second inclined plane 16 and the second plane 17, as well as between the second plane 17 and the third inclined plane 18 through an arc with a radius of 10 mm to 30 mm (e.g. 10 mm, 12 mm, 14 mm, 16 mm, 18 mm, 20 mm, 22 mm, 24 mm, 26 mm, 28 mm, 30 mm). The smooth transitions are achieved between the first inclined plane 14 and the first plane 15, between the first plane 15 and the second inclined plane 16, between the third inclined plane 18 and the third plane 19, between the third plane 19 and the fourth inclined plane 20, between the fifth inclined plane 21 and the fourth plane 22, between the fourth plane 22 and the sixth inclined plane 23 through an arc with a radius of 25 mm to 60 mm (e.g. 25 mm, 30 mm, 35 mm, 40 mm, 45 mm, 50 mm, 55 mm, 60 mm). The setting of the above parameters can achieve uniform deformation at the joints of various parts of the billet, reduce cutting resistance, and at the same time enable the first center column 12 to grow to the ideal height as much as possible, meeting the size control needs of the side wing 53 of the finished product of the single-tooth track plate 5.

Specifically, as shown in FIG. 4, a length of the first inclined plane 14 is B1, and a vertical distance between the second plane 17 and the first plane 15 is H1, and B1:H1=0.7~2:1, a length of the fourth inclined plane 20 is B2, and B2:H1=0.5~1.2:1. The design of the tilt angle and length of the first inclined plane 14 can ensure that the billet is stable during the rolling of the first cogging hole 1, while also providing a suitable length of billet for the right flat limb 31 of the second cogging hole 3, to prevent the occurrence of insufficient or excessive metal. The design of the tilt angle and length of the fourth inclined plane 20 can ensure that the billet is stable during the rolling of the first cogging hole 1, while also providing a suitable length of billet for the left flat limb 33 of the second cogging hole 3, to prevent the occurrence of insufficient or excessive metal.

Furthermore, as shown in FIG. 2, a lower surface of the second upper roller includes a seventh inclined plane 34, an eighth inclined plane 35, a ninth inclined plane 36, a fifth plane 37, a tenth inclined plane 38, an eleventh inclined plane 39, and a twelfth inclined plane 40, the seventh inclined plane 34, the eighth inclined plane 35, the ninth inclined plane 36, the fifth plane 37, the tenth inclined plane 38, the eleventh inclined plane 39, and the twelfth inclined plane 40 are sequentially connected, the fifth plane 37 is set horizontally, and lower ends of the seventh inclined plane 34 and the twelfth inclined plane 40 are located on a same horizontal plane, the eighth inclined plane 35 and the eleventh inclined plane 39 are both located above the twelfth inclined plane 40, the ninth inclined plane 36 and the tenth inclined plane 38 are both located above the eleventh inclined plane 39, the ninth inclined plane 36, the fifth plane 37, and the tenth inclined plane 38 form a trapezoidal groove on a lower surface of the second upper roller. The upper surface of the second lower roller includes a sixth plane 41, an arc segment 42, and a seventh plane 43, the sixth plane 41, the arc segment 42, and the seventh plane 43 are sequentially connected, The sixth plane 41 and the seventh plane 43 are located on the same horizontal plane, and the arc segment 42 is located above the sixth plane 41. The radius of arc segment 42 is 50 mm to 120 mm (e.g. 50 mm, 55 mm, 60 mm, 65 mm, 70 mm, 75 mm, 80 mm, 85 mm, 90 mm, 95 mm, 100 mm, 105 mm, 110 mm, 115 mm, 120 mm), a length of the arc segment 42 is 80 mm to 200 mm (e.g. 80 mm, 90 mm, 100 mm, 110 mm, 120 mm, 130 mm, 140 mm, 150 mm, 160 mm, 170 mm, 180 mm, 190 mm, 200 mm). The setting of the arc segment 42 enables the lower part of the billet to extrude a bridge shape with flat sides and raised middle. During rolling, the second upper roller and the second lower roller of the cogging mill can stably clamp the billet, the billet is in a stable state and will not shake or overturn, eliminating the shortcomings of low efficiency, poor safety and poor dimensional accuracy caused by the instability of the billet, and realizing the efficient production of the single-tooth track plate 5.

The seventh inclined plane 34 and the eighth inclined plane 35 cooperate with the sixth plane 41 to form the right flat limb 31 of the second cogging hole 3. The ninth inclined plane 36, the fifth plane 37 and the tenth inclined plane 38 cooperate with the arc segment 42 to form the second center column 32 of the second cogging hole 3. The eleventh inclined plane 39 and the twelfth inclined plane 40 cooperate with the seventh plane 43 to form the left flat limb 33 of the second cogging hole 3. The shape of the second center column 32 of the second cogging hole 3 is similar to that of the first center column 12 of the first cogging hole 1, which can make the mountain shaped middle billet stable during rolling in the second cogging hole 3. The design of the right flat limb 31 and the left flat limb 33 of the second cogging hole 3 can reduce the thickness of the billet while straightening a part of the mountain shaped middle billet corresponding to the right bent limb 11 and the left bent limb 13 of the first cogging hole 1, which can further promote the growth of a part of the mountain shaped middle billet corresponding to the main plate 51 and the tooth plate 52 of the single-tooth track plate 5. The design of the arc segment 42 of the second cogging hole 3 can promote metal flow from this area to the upper part of the second center column 32 of the second cogging hole 3, promote its height, and provide a shape that is close in size and easy to bite for subsequent rolling. The cooperation of the sixth plane 41, the seventh plane 43 and the arc segment 42 of the second cogging hole 3 enables the lower part of the billet to extrude a bridge shape with flat sides and raised middle. During rolling, the billet is in a stable state and will not shake or overturn, eliminating the shortcomings of low efficiency, poor safety and poor dimensional accuracy caused by the instability of the billet, and realizing the efficient production of the single-tooth track plate 5.

Figure 5:
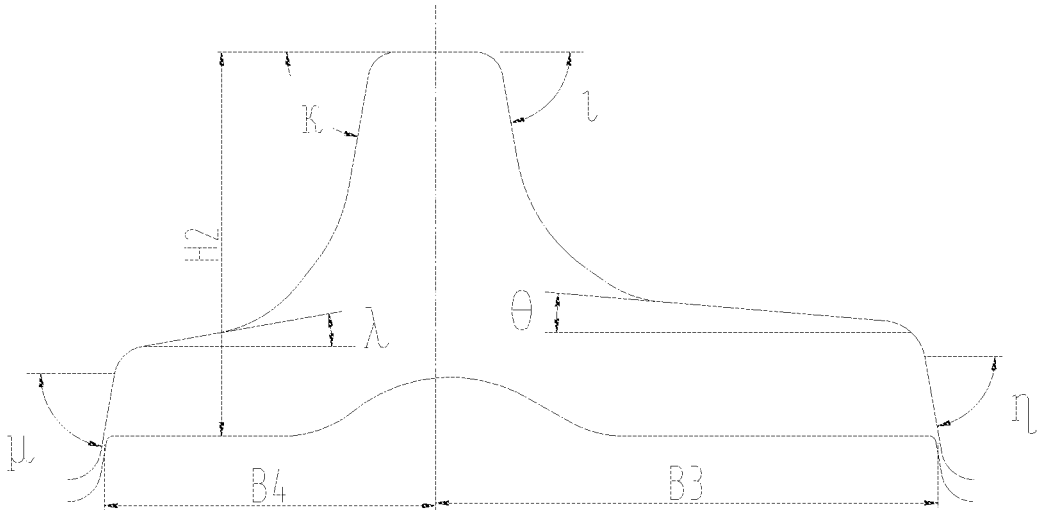
FIG. 5 shows another structural schematic diagram of a second cogging hole in an embodiment of the present disclosure.

Furthermore, as shown in FIG. 5, an angle $\eta$ between the seventh inclined plane 34 and the plane is 60°-88° (e.g. 60°, 62°, 64°, 66°, 68°, 70°, 72°, 74°, 76°, 78°, 80°, 82°, 84°, 86°, 88°); an angle $\theta$ between the eighth inclined plane 35 and the plane is 0°-30° (e.g. 0°, 5°, 10°, 15°, 20°, 25°, 30°); an angle $\iota$ between the ninth inclined plane 36 and the fifth plane 37 is 70°-88° (e.g. 70°, 72°, 74°, 76°, 78°, 80°, 82°, 84°, 86, 88°); an angle $\kappa$ between the tenth inclined plane 38 and the fifth plane 37 is 70°-88° (e.g. 70°, 72°, 74°, 76°, 78°, 80°, 82°, 84°, 86, 88°); an angle $\lambda$ between the eleventh inclined plane 39 and the plane is 0°-30° (e.g. 0°, 5°, 10°, 15°, 20°, 25°, 30°); an angle $\mu$ between the twelfth inclined plane 40 and the plane is 60°-88° (e.g. 60°, 62°, 64°, 66°, 68°, 70°, 72°, 74°, 76°, 78°, 80°, 82°, 84°, 86, 88°). In an embodiment of the present disclosure, $\eta$ is 80°, $\theta$ is 5°, $\iota$ is 80°, $\kappa$ is 80°, $\lambda$ is 10°, $\mu$ is 80°.

Appropriate arc transitions are achieved between the seventh inclined plane 34 and the eighth inclined plane 35, between the ninth inclined plane 36 and the fifth plane 37, between the fifth plane 37 and the tenth inclined plane 38, between the eleventh inclined plane 39 and the twelfth inclined plane 40, specifically, a smooth transition is achieved between the seventh inclined plane 34 and the eighth inclined plane 35, between the ninth inclined plane 36 and the fifth plane 37, between the fifth plane 37 and the tenth inclined plane 38, between the eleventh inclined plane 39 and the twelfth inclined plane 40 through an arc with a radius of 10 mm to 30 mm (e.g. 10 mm, 12 mm, 14 mm, 16 mm, 18 mm, 20 mm, 22 mm, 24 mm, 26 mm, 28 mm, 30 mm) A smooth transition is achieved between the eighth inclined plane 35 and the ninth inclined plane 36, between the tenth inclined plane 38 and the eleventh inclined plane 39 through an arc with a radius of 50 mm to 80 mm (e.g. 50 mm, 55 mm, 60 mm, 65 mm, 70 mm, 75 mm, 80 mm). The setting of the above parameters can achieve uniform deformation at the joints of various parts of the billet, and accurately control the state of the billet, achieving stable rolling of the second cogging hole 3.

Furthermore, a length of the right flat limb 31 is B3, a vertical distance between the fifth plane 37 and the sixth plane 41 is H2, B3:H2=1~2:1; a length of the left flat limb 33 is B4, B4:H2=0.6~1.2:1. The setting of the above parameters can reduce the thickness of the billet while straightening the right bent limb 11 and the left bent limb 13 of the mountain shaped middle billet, and further promote the growth of the main plate 11 and the tool plate 52 of the single-tooth track plate 5.

Furthermore, the width of the continuous casting billet shall not be less than the width W1 of the fourth plane 22 on the upper surface of the first lower roller, and the width of the continuous casting billet shall not be greater than the width W2 of the first cogging hole 1, and a ratio of the height to the width of the continuous casting billet shall be 0.7-1.3 (e.g. 0.7, 0.8, 0.9, 1.0, 1.1, 1.2, 1.3). The above design of the width and the height for continuous casting billets can achieve the goal of good forming of the main plate 51, the tooth plate 52, and the side wing 53 of the single-tooth track plate 5, reducing the dependence on billet size, allowing for the production of larger single-tooth track plate 5 using smaller billets, which has a good energy-saving and cost saving effects.

The present disclosure further provides a hot rolling method for single-tooth track plate 5, utilizing the above-mentioned single-tooth track plate cogging-down pass, which includes the following steps:

step 1) using the cogging mill to cog down the rectangular continuous casting billet, the continuous casting billet are rolled sequentially by 1 to 4 first cogging holes 1, and the continuous casting billet is gradually rolled out into the right bent limb 11, the first center column 12, and the left bent limb 13, the first inclined plane 14 and the first plane 15 cooperate with the fifth inclined plane 21 and the fourth plane 22 to form the right bent limb 11, the second inclined plane 16, the second plane 17 and the third inclined plane 18 cooperate with the fourth plane 22 to form the first center column 12, the third plane 19 and the fourth inclined plane 20 cooperate with the fourth plane 22 and the sixth inclined plane 23 to form the left bent limb 13, and a cross-section of the continuous casting billet changes from a rectangle to a mountain shape, thus obtaining a mountain shaped middle billet.

step 2), using the cogging mill to further cog down the mountain shaped middle billet obtained in step 1), and the mountain shaped middle billet is rolled by 1 to 4 second cogging holes 3, the seventh inclined plane 34 and the eighth inclined plane 35 cooperate with the sixth plane 41 to gradually flatten and thin the right bent limb 11 of the mountain shaped middle billet to form the right flat limb 31, the ninth inclined plane 36, the fifth plane 37, and the tenth inclined plane 38 cooperate with the arc segment 42 to gradually thin and grow the first center column 12 to form the second center column 32, and to extrude the fourth plane 22 out into the arc segment 42, the eleventh inclined plane 39 and the twelfth inclined plane 40 cooperate with the seventh plane 43 to gradually flatten and thin the left bent limb 13 to form the left flat limb 33, a cross-section of the mountain shaped middle billet changes from a mountain shape to an inverted T-shape, thus obtaining an inverted T-shaped middle billet.

step 3) roughly rolling the inverted T-shaped middle billet obtained by cogging down the first cogging hole 1 and the second cogging hole 3 to reduce the thickness and increase the width of the billet.

step 4) performing finish rolling on the rough rolled billet in Step 3, and accurately shape each part of the billet corresponding to a main plate 51, a side wing 53, and a tooth plate 52 of the single-tooth track plate 5 to obtain the single-tooth track plate 5, wherein the right flat limb 31 is rolled into the main plate 51 of the single-tooth track plate 5, the second center column 32 is rolled into the side wing 53 of the single-tooth track plate 5, and the left flat limb 33 is rolled into the tooth plate 52 of the single-tooth track plate 5.

Cog down the rectangular continuous casting billet through the first cogging hole 1 and the second cogging hole 3 of the cogging mill, the billet after cogging down is then rough rolled and finish rolled to obtain a single-tooth track plate 5. The design of the side wing 53 made from the billet and the second center column 32 of the second cogging hole 3 solves the shortcomings of the side wing 53 being prone to overfilling and difficult to adjust in the existing technology. The design of the tool plate 52 made from a portion of the billet corresponding to the left flat limb 33 of the second cogging hole 3 overcomes the defects of insufficient metal of the tooth plate 52 and poor molding in the existing technology.

From the above description, it can be seen that the present disclosure achieves the following technical effects:

The present disclosure discloses a single-tooth track plate cogging-down pass and a hot rolling method. The rectangular continuous casting billet is cogged down through the first cogging hole 1 and second cogging hole 3 of the cogging mill, and the billet after cogging down is then rough rolled and finish rolled to obtain the single-tooth track plate 5. The present disclosure significantly reduces the dependence on billet size, allowing for the production of larger single-tooth track plates 5 using smaller billets, which has a good energy-saving and consumption reducing effect. The unique design of the first cogging hole 1 and second cogging hole 3 eliminate the shortcomings of low efficiency, poor safety, and poor dimensional accuracy caused by the instability of billets, and realizes the efficient production of single-tooth track plate 5.

The above is only a preferred embodiment of the present disclosure and is not intended to limit it. For those skilled in the art, the present disclosure may have various modifications and variations. Any modifications, equivalent replacements, improvements, etc. made within the spirit and principles of the present disclosure shall be included within the protection scope of the present disclosure.

The invention claimed is:

1. A hot rolling method for single-tooth track plate, utilizing a single-tooth track plate cogging-down pass, wherein the method includes the following steps of:

step 1) using a cogging mill to cog down a rectangular continuous casting billet, the continuous casting billet are rolled sequentially by 1 to 4 first cogging holes, and the continuous casting billet is gradually rolled out into a right bent limb, a first center column, and a left bent limb of the first cogging holes, the first cogging holes comprising a first inclined plane, a second inclined plane, a third inclined plane, a fourth inclined plane, a fifth inclined plane, a sixth inclined plane, and a first plane, a second plane, a third plane and a fourth plane; wherein, the first inclined plane and the first plane cooperate with the fifth inclined plane and the fourth plane to form the right bent limb, the second inclined plane, the second plane and the third inclined plane cooperate with the fourth plane to form the first center column, the third plane and the fourth inclined plane cooperate with the fourth plane and the sixth inclined plane to form the left bent limb, and a cross-section of the continuous casting billet changes from a rectangle to a mountain shape, thus obtaining a mountain shaped middle billet, the mountain shape is a shape having three mountain peaks, wherein a rightmost peak corresponds to the right bent limb, a middle peak corresponds to the first center column and a leftmost peak corresponds to the left bent limb, the third plane is between the leftmost peak and the middle peak, and the first plane is between the middle peak and the rightmost peak;

step 2), using the cogging mill to further cog down the mountain shaped middle billet obtained in step 1), and the mountain shaped middle billet is rolled by 1 to 4 second cogging holes, the second cogging holes comprising a seventh inclined plane, an eighth inclined plane, a ninth inclined plane, a tenth inclined plane, an eleventh inclined plane and a twelfth inclined plane, as well as a fifth plane, a sixth plane and a seventh plane, wherein the seventh inclined plane and the eighth inclined plane cooperate with the sixth plane to gradually flatten and thin the right bent limb of the mountain shaped middle billet to form a right flat limb, the ninth inclined plane, the fifth plane, and the tenth inclined plane cooperate with an arc segment to gradually thin and grow the first center column to form a second center column, and to extrude the fourth plane out into the arc segment, the eleventh inclined plane and the twelfth inclined plane cooperate with the seventh plane to gradually flatten and thin the left bent limb to form a left flat limb, a cross-section of the mountain shaped middle billet changes from the mountain shape to an inverted T-shape, thus obtaining an inverted T-shaped middle billet;

step 3) roughly rolling the inverted T-shaped middle billet obtained by cogging down the first cogging hole and the second cogging hole to reduce the thickness and increase the width of the billet;

step 4) performing finish rolling on the rough rolled billet in step 3, and accurately shape each part of the billet corresponding to a main plate, a side wing, and a tooth plate of the single-tooth track plate to obtain the single-tooth track plate, wherein the right flat limb is rolled into the main plate of the single-tooth track plate, the second center column is rolled into the side wing of the single-tooth track plate, and the left flat limb is rolled into the tooth plate of the single-tooth track plate, wherein the single-tooth track plate cogging-down pass comprises the first cogging hole and the second cogging hole, wherein the first cogging hole is formed by a first upper roller and a first lower roller of the cogging mill, and the second cogging hole is formed by a second upper roller and a second lower roller of the cogging mill, wherein the first cogging hole is a front hole, and the first cogging hole is used to extrude the rectangular continuous casting billet into the mountain shaped middle billet including the right bent limb, the first center column, and the left bent limb, wherein the second cogging hole is a rear hole, the second cogging hole is used to extrude the mountain shaped middle billet into the inverted T-shaped middle billet including the right flat limb, the second center column, and the left flat limb, wherein a lower surface of the first upper roller includes the first inclined plane, the first plane, the second inclined plane, the second plane, the third inclined plane, the third plane, and the fourth inclined plane, the first inclined plane, the first plane, the second inclined plane, the second plane, the third inclined plane, the third plane, and the fourth inclined plane are sequentially connected, the first plane and the third plane are located on a same horizontal plane, the first inclined plane, the second inclined plane, the third inclined plane, and the fourth inclined plane are all located above the first plane, the second plane is parallel to the first plane, the second inclined plane, the second plane, and the third inclined plane form a trapezoidal groove on the lower surface of the first upper roller.

wherein an angle α between the first inclined plane and the first plane is 30°-70°, an angle β between the second inclined plane and the first plane is 65°-88°, an angle γ between the third inclined plane and the third plane is 65°-88°, an angle δ between the fourth inclined plane and the third plane is 30°-70°, specifically, a smooth transition is achieved between the second inclined plane and the second plane, between the second plane and the third inclined plane through an arc with a radius of 10 mm to 30 mm, a smooth transition is achieved between the first inclined plane and the first plane, between the first plane and the second inclined plane, between the third inclined plane and the third plane, and between the third plane and the fourth inclined plane through an arc with a radius of 25 mm to 60 mm, specifically, a length of the first inclined plane is B1, and a vertical distance between the second plane and the first plane is H1, and B1:H1=0.7~2:1, a length of the fourth inclined plane is B2, and B2:H1=0.5~1.2:1.

2. The hot rolling method for single-tooth track plate according to claim 1, wherein an upper surface of the first lower roller includes the fifth inclined plane, the fourth plane, and the sixth inclined plane, the fifth inclined plane, the fourth plane, and the sixth inclined plane are sequentially connected, and the fifth inclined plane and the sixth inclined plane are both located above the fourth plane, specifically, an angle ε between the fifth inclined plane and the fourth plane is 50°-88°, an angle ζ (between the fourth plane and the sixth inclined plane is 50°-88°, specifically, a smooth transition is achieved between the fifth inclined plane and the fourth plane, and between the fourth plane and the sixth inclined plane through an arc with a radius of 25 mm to 60 mm.

3. The hot rolling method for single-tooth track plate according to claim 2, wherein a width of the continuous casting billet is not less than a width W1 of the fourth plane on the upper surface of the first lower roller, a width of the continuous casting billet is not greater than a width W2 of the first cogging hole, and a ratio of the height to the width of the continuous casting billet is 0.7-1.3.

4. The hot rolling method for single-tooth track plate according to claim 1, wherein a lower surface of the second upper roller includes the seventh inclined plane, the eighth inclined plane, the ninth inclined plane, the fifth plane, the tenth inclined plane, the eleventh inclined plane, and the twelfth inclined plane, the seventh inclined plane, the eighth inclined plane, the ninth inclined plane, the fifth plane, the tenth inclined plane, the eleventh inclined plane, and the twelfth inclined plane are sequentially connected, the fifth plane is set horizontally, and lower ends of the seventh inclined plane and the twelfth inclined plane are located on a same horizontal plane, the eighth inclined plane and the eleventh inclined plane are both located above the twelfth inclined plane, the ninth inclined plane and the tenth inclined plane are both located above the eleventh inclined plane, the ninth inclined plane, the fifth plane, and the tenth inclined plane form a trapezoidal groove on a lower surface of the second upper roller.

5. The hot rolling method for single-tooth track plate according to claim 4, wherein an angle η between the seventh inclined plane and the horizontal plane is 60°-88°, an angle θ between the eighth inclined plane and the horizontal plane is 0°-30°, an angle ι between the ninth inclined plane and the fifth plane is 70°-88°, an angle κ between the tenth inclined plane and the fifth plane is 70°-88°, an angle λ between the eleventh inclined plane and the horizontal plane is 0°-30°, an angle μ between the twelfth inclined plane and the horizontal plane is 60°-88°, specifically, a smooth transition is achieved between the seventh inclined plane and the eighth inclined plane, between the ninth inclined plane and the fifth plane, between the fifth plane and the tenth inclined plane, and between the eleventh inclined plane and the twelfth inclined plane through an arc with a radius of 10 mm to 30 mm, a smooth transition is achieved between the eighth inclined plane and the ninth inclined plane, and between the tenth inclined plane and the eleventh inclined plane through an arc with a radius of 50 mm to 80 mm.

6. The hot rolling method for single-tooth track plate according to claim 4, wherein an upper surface of the second lower roller includes the sixth plane, the arc segment, and the seventh plane, the sixth plane, the arc segment, and the seventh plane are sequentially connected, and the sixth plane and the seventh plane are located on a same horizontal plane, the arc segment is located above the sixth plane, a radius of the arc segment is 50 mm to 120 mm and a length of the arc segment is 80 mm to 200 mm.

7. The hot rolling method for single-tooth track plate according to claim 6, wherein a length of the right flat limb is B3, and a vertical distance between the fifth plane and the sixth plane is H2, and B3:H2=1-2:1, a length of the left flat limb is B4, and B4:H2-0.6-1.2:1.

* * * * *